US009714151B2

(12) United States Patent
Suzuki

(10) Patent No.: US 9,714,151 B2
(45) Date of Patent: Jul. 25, 2017

(54) PRINTING CONTROL APPARATUS, METHOD FOR CONTROLLING PRINTING CONTROL APPARATUS, AND STORAGE MEDIUM

(71) Applicant: CANON KABUSHIKI KAISHA, Tokyo (JP)

(72) Inventor: Kiwamu Suzuki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 82 days.

(21) Appl. No.: 13/771,758

(22) Filed: Feb. 20, 2013

(65) Prior Publication Data

US 2013/0214472 A1 Aug. 22, 2013

(30) Foreign Application Priority Data

Feb. 22, 2012 (JP) ..... 2012-035977

(51) Int. Cl.

| | |
|---|---|
| ***B65H 39/00*** | (2006.01) |
| ***B65H 39/10*** | (2006.01) |
| ***B42B 4/00*** | (2006.01) |
| ***B42B 5/00*** | (2006.01) |
| ***B65H 37/04*** | (2006.01) |
| ***G03G 15/00*** | (2006.01) |

(52) U.S. Cl.

CPC ..... *B65H 39/00* (2013.01); *B42B 4/00* (2013.01); *B42B 5/00* (2013.01); *B65H 37/04* (2013.01); *B65H 39/10* (2013.01); *G03G 15/6544* (2013.01); *B65H 2301/4213* (2013.01); *B65H 2301/43828* (2013.01); *B65H 2301/51616* (2013.01); *B65H 2408/122* (2013.01); *B65H 2408/40* (2013.01); *B65H 2801/27* (2013.01)

(58) Field of Classification Search

CPC ..... B65H 2301/43828; B65H 2301/51616; B65H 2408/40; B31F 5/02

USPC ..... 399/407–410; 270/58.07, 58.08, 58.09, 270/58.12, 58.17

See application file for complete search history.

(56) References Cited

U.S. PATENT DOCUMENTS

| | | | | |
|---|---|---|---|---|
| 7,456,980 | B2 * | 11/2008 | Kuboki | 358/1.13 |
| 2003/0029875 | A1 * | 2/2003 | Sesek | 220/589 |
| 2007/0171455 | A1 * | 7/2007 | Tominaga | 358/1.14 |
| 2007/0187883 | A1 * | 8/2007 | Tokashiki | 270/1.01 |
| 2009/0316184 | A1 * | 12/2009 | Ohyama | G06F 3/1205 358/1.15 |

(Continued)

FOREIGN PATENT DOCUMENTS

| | | | |
|---|---|---|---|
| CN | 1126670 | A | 7/1996 |
| CN | 101046728 | A | 10/2007 |

(Continued)

*Primary Examiner* — Jennifer Simmons

(74) *Attorney, Agent, or Firm* — Canon U.S.A., Inc. IP Division

(57) ABSTRACT

A printing control apparatus that can perform a binding processing without staples and a binding processing with staples includes a printing unit to print image data on a sheet, and a control unit that controls, in a case where image data is printed on sheets for test printing, a second binding unit to perform a binding processing for binding a plurality of printed sheets without staples, and controls, in a case where image data is printed on sheets after test printing, a first binding unit to perform a binding processing for binding a plurality of printed sheets with a staple.

8 Claims, 12 Drawing Sheets

(56) References Cited

U.S. PATENT DOCUMENTS

2011/0222945 A1* 9/2011 Sato ..... 399/408

FOREIGN PATENT DOCUMENTS

| | | | |
|---|---|---|---|
| CN | 101196969 | A | 6/2008 |
| CN | 102190200 | A | 9/2011 |
| JP | 8-300847 | A | 11/1996 |
| JP | 2002-104723 | A | 4/2002 |
| JP | 2004-032704 | A | 1/2004 |
| JP | 2004167700 | A | 6/2004 |
| JP | 2008-245322 | A | 10/2008 |
| JP | 2009282905 | A | 12/2009 |
| JP | 2011-184153 | A | 9/2011 |

* cited by examiner

PRINTING CONTROL APPARATUS, METHOD FOR CONTROLLING PRINTING CONTROL APPARATUS, AND STORAGE MEDIUM

BACKGROUND OF THE INVENTION

Field of the Invention

Aspects of the present invention generally relate to a printing control apparatus for controlling binding processing of binding a plurality of sheets, a method for controlling the printing control apparatus, and a storage medium.

Description of the Related Art

Some of image processing apparatuses having copy and printer functions are provided with a sheet processing apparatus for applying post-print processing to output print sheets. One of typical functions provided by the sheet processing apparatus is a staple binding function. The staple binding function is a function of binding sheets by using a metal staple.

Since a stapled print product is easy to handle on a volume basis, staple binding is widely used when handling an output product having a plurality of pages.

For this reason, some of image processing apparatuses having copy and printer functions are provided with a sheet processing function for applying post-print processing to output print sheets. An example of the sheet processing function is a staple binding function. The staple binding function is a function of binding a sheet bundle (print product) generally by using a metal staple. Since a stapled print product is easy to handle on a volume basis, staple binding is widely used when handling a print product having a plurality of pages.

Recently, however, environment-friendliness has been considered from a view point of use of the metal staple, so that some binding methods without using a metal staple (hereinafter referred to as stapleless binding methods) have been devised. For example, a certain stapleless binding method collectively cuts out a part of a set of print sheets subjected to binding so as to bore the sheets, and weaves the tips of the cut portions to bind the sheets (refer to Japanese Patent Application Laid-Open No. 8-300847).

When printing a plurality of copies, a user can use a technique for printing only one copy and confirming the outcome of the print product. This technique is referred to as a test printing function. Known techniques related to the test printing function include a technique for changing, at the time of test printing, paper used for printing to plain paper when special paper is included in paper to be used for printing, and a technique for specifying the number of pages subjected to test printing and printing only the specified number of pages (refer to Japanese Patent Application Laid-Open No. 2008-245322).

With a conventional image processing apparatus configured as described above, when checking the outcome of a stapled print product by using the above-described test printing function, a user may not immediately acquire a desired print product and therefore may repetitively perform the test printing function. In such a case, since an output print product is bound with a staple each time test printing is made, staples are wastefully consumed. Further, staple binding has a disadvantage that, when discarding a stapled print product, the user needs to remove the staple from the print product causing user's trouble.

SUMMARY OF THE INVENTION

An aspect of the present invention relates to providing a mechanism with which performing stapleless binding processing, instead of applying staple binding processing, for test printing enables reducing the amount of staples used and eliminating the need of removing a staple from a print product for test printing.

According to an aspect of the present invention, a printing control apparatus is configured to control a first binding unit to perform binding processing of binding a plurality of sheets with a staple and a second binding unit to perform binding processing of binding a plurality of sheets without a staple. The printing control apparatus includes a printing unit configured to print image data on a sheet, and a control unit configured to control, in a case where the printing unit prints image data on sheets for test printing, the second binding unit to perform the binding processing for binding a plurality of printed sheets, and to control, in a case where the printing unit prints the image data on sheets after test printing, the first binding unit to perform the binding processing for binding a plurality of printed sheets.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
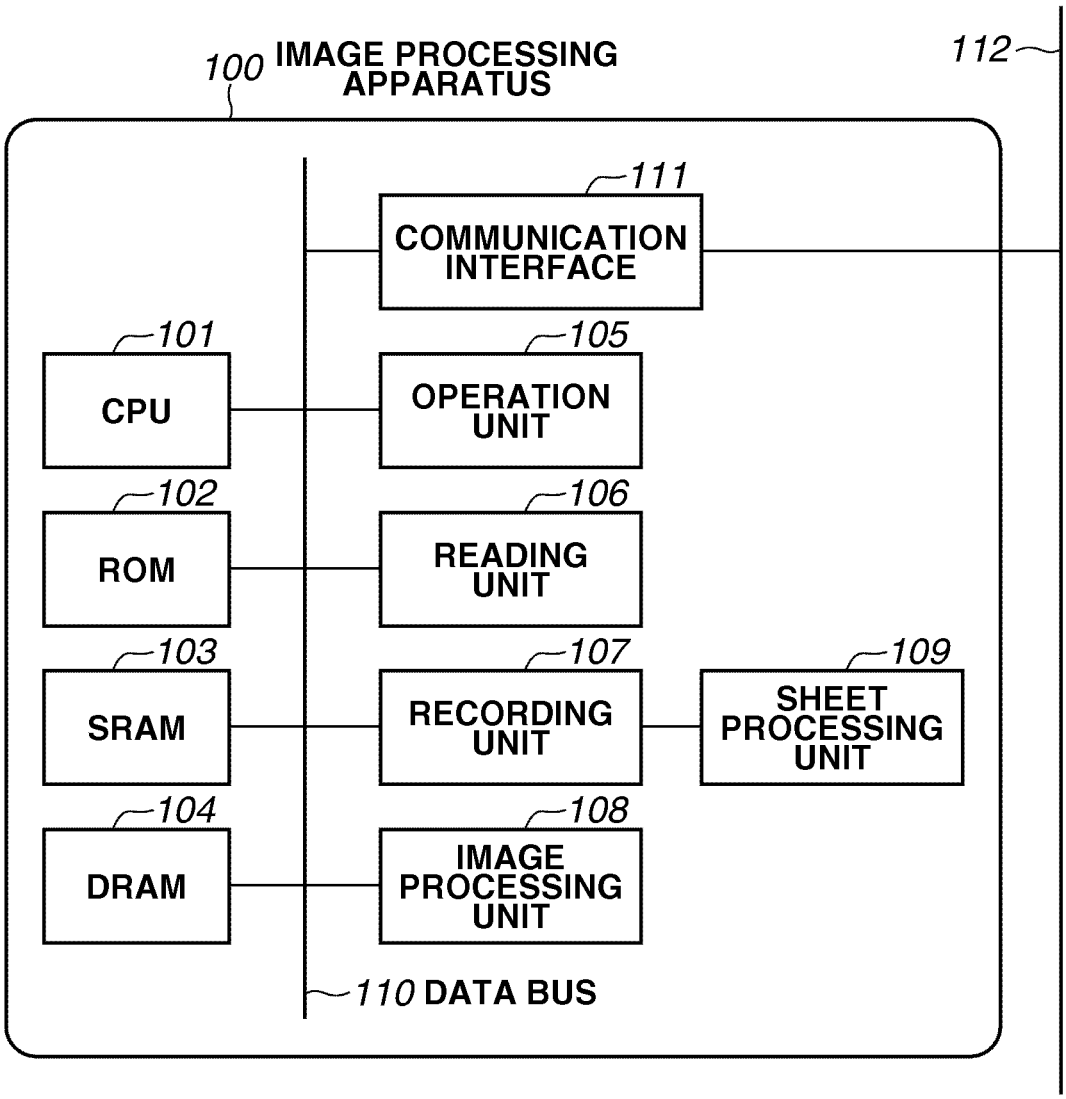
FIG. 1 is a block diagram illustrating a configuration of an image processing apparatus.

A first exemplary embodiment will be described below. FIG. 1 is a block diagram illustrating a configuration of an image processing apparatus 100 according to the present exemplary embodiment, where the image processing apparatus 100 is an example of a printing control apparatus. While the following description refers to the image processing apparatus 100, any apparatus that would function as a printing control apparatus would be applicable. In this example, a sheet processing unit that performs sheet post-processing is implemented as part of the image processing apparatus 100 having a function of reading an image and a function of printing an image on a sheet. In another embodiment, the sheet processing apparatus is implemented as an apparatus separate from the image processing apparatus.

Referring to FIG. 1, a central processing unit (CPU) 101 is a control unit of a system for controlling the entire apparatus. A read-only memory (ROM) 102 stores a control program for the CPU 101. A static random access memory (SRAM) 103 stores setting values registered by an operator, management data of the apparatus, and various working buffers. Since the SRAM 103 is a nonvolatile SRAM backed up by a battery, the contents of the SRAM 103 are retained even after the power of the apparatus is turned OFF.

The SRAM 103 also stores read image data. Information about the binding processing registered by the user (described below) is also registered in the SRAM 103 and referred to by the CPU 101 to control flowcharts (described below).

A dynamic random access memory (DRAM) 104 stores program control parameters. An operation unit 105 is a user interface unit that displays information inside the apparatus. The operation unit 105 is configured to display user interface screens (described below). A reading unit 106 reads image data and converts it into binary data. The reading unit 106 is used to read a document during execution of an image transmission function. A recording unit 107 prints image data on a sheet. An image processing unit 108 performs coding and decoding processing for image data handled by the image transmission function. The above-described function units are connected via a data bus 110 through which image data is transferred.

The recording unit 107 is connected to a sheet processing unit 109. A sheet printed by the recording unit 107 is conveyed to the sheet processing unit 109. The sheet processing unit 109 performs post-print processing such as truing up input sheets, selecting an output tray, and binding processing of binding a plurality of sheets. The present exemplary embodiment distinctively uses two different binding processing, a first binding processing of binding sheets by using a staple and a second binding processing of binding sheets without using a staple.

With the thus-configured image processing apparatus, the reading unit 106 reads a document image, converts the image into binary data, and once stores the read image data in the SRAM 103. An example of printing control will be described below, in which the image processing unit 108 converts the image data stored in the SRAM 103, the recording unit 107 prints the image on a sheet, and the sheet processing unit 109 performs post-print processing.

Figure 2:
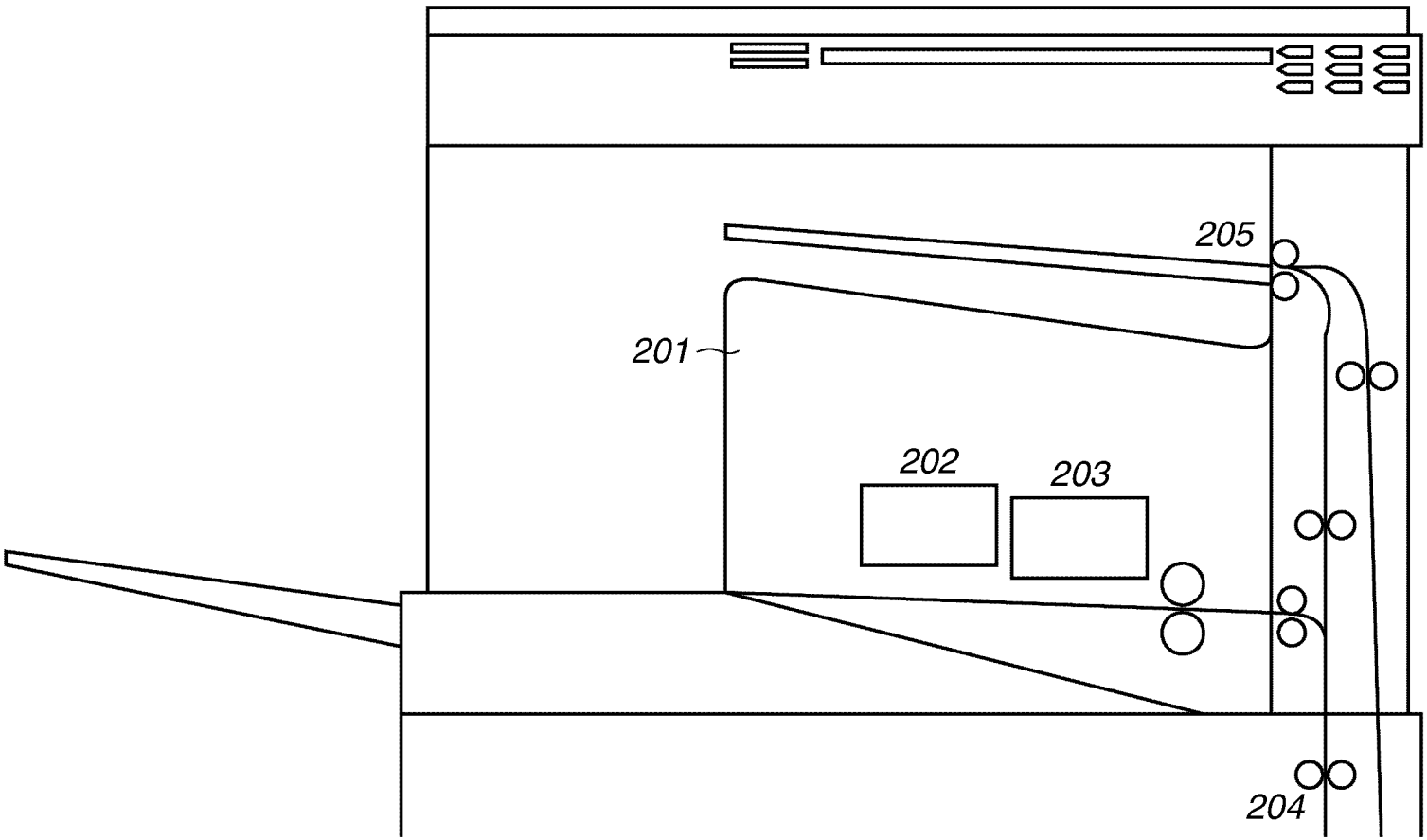
FIG. 2 is a cross sectional view illustrating an example configuration of a sheet processing unit.

FIG. 2 is cross sectional view illustrating in more detail an example configuration of the sheet processing unit 109 illustrated in FIG. 1. In this example, the sheet processing unit 109 is installed in a housing of the sheet processing apparatus of the image processing apparatus.

Descriptions on the recording unit 107 having an engine for executing print processing will be omitted. The sheet processing unit 109 is connected to the main unit of the image processing apparatus. Although connection modes of the sheet processing unit 109 include the in-line mode and other modes, the application of the present invention is not limited thereto.

Referring to FIG. 2, a sheet processing apparatus 201 is connected to the recording unit 107. A sheet is conveyed from the recording unit 107 to the sheet processing apparatus 201 through a conveyance roller pair 204. A conveyance roller pair 205 reverses a sheet for two-sided printing. After being reversed, the sheet enters the recording unit 107 again through the conveyance roller pair 205, and printing is made on the rear surface of the sheet. Also in this case, an output sheet is sent to the sheet processing apparatus 201 through the conveyance roller pair 204. Although the sheet processing apparatus 201 is provided with a function of truing up output sheets and a function of moving output sheets, a binding function will be focused below.

A first binding unit 202 is a stapler having a staple binding function that uses a metal staple. A second binding unit 203 has a stapleless sheet binding function that does not use a staple. Although there are many types of stapleless binding methods as described above, the sheet processing unit 201 is provided with a stapleless binding method for binding sheets by applying pressure thereto from the upside and downside (in the thickness direction) to achieve close contact therebetween.

Thus described sheet processing apparatus 201 includes both the first binding unit 202 and the second binding unit 203 is taken as an example.

When using the stapleless binding function, it is necessary to secure a larger portion in the sheet for processing than that for staple binding, as described above.

Figure 3:
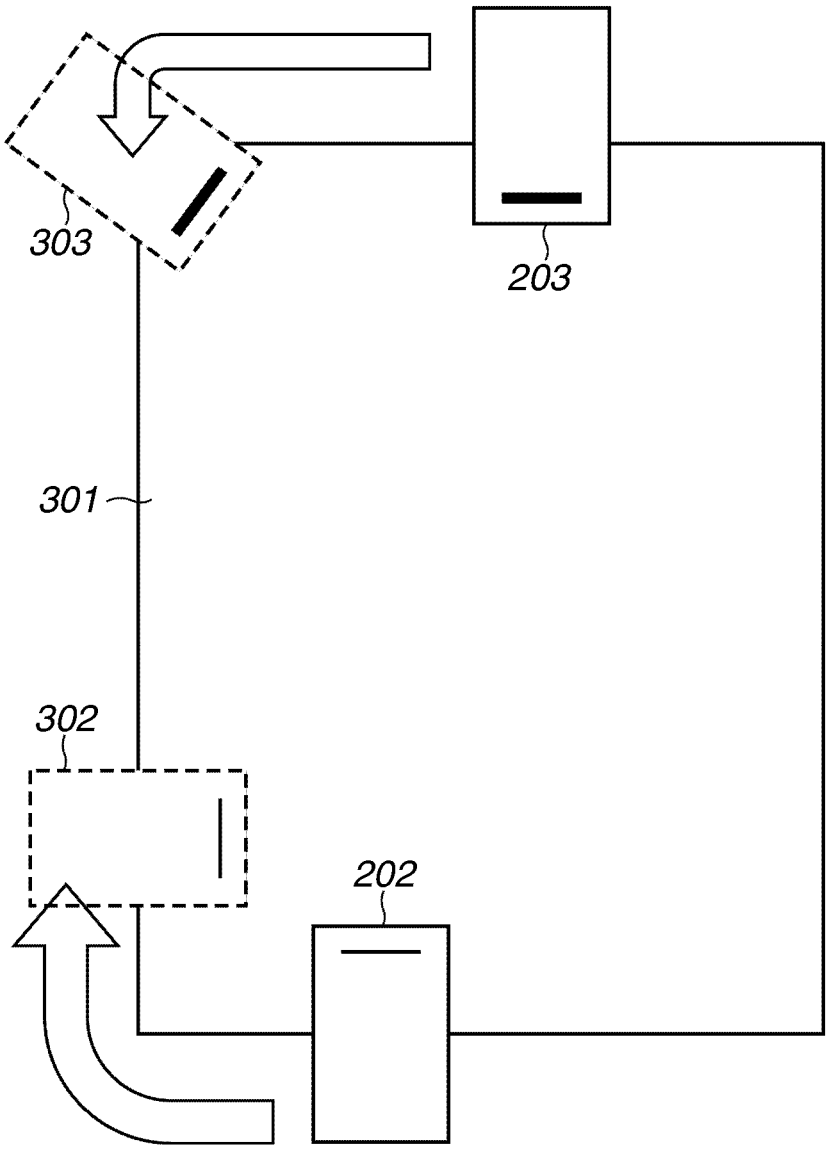
FIG. 3 illustrates arrangements of binding portions and binding work areas.

FIG. 3 illustrates arrangements of the first binding unit 202 and the second binding unit 203 illustrated in FIG. 2, and the binding work areas.

FIG. 3 illustrates sheets 301 subjected to binding and the first binding unit 202 stopped at a standby position. The first binding unit 202 is configured to move from the standby position to a binding position 302 indicated by an arrow and then binds the sheets when actually binding the sheets 301. Although a mechanism for moving the first binding unit 202 is omitted, its movement is controlled by an instruction from the CPU 101.

Likewise, the second binding unit 203 that performs stapleless binding is regularly stopped at a standby position and, is configured, when actually binding the sheets, to move from a standby position to a binding position 303 and then binds the sheets. As described above, the first binding unit 202 and the second binding unit 203 are movable under the control of the CPU 101 illustrated in FIG. 1 depending on various binding methods.

Figure 4A:
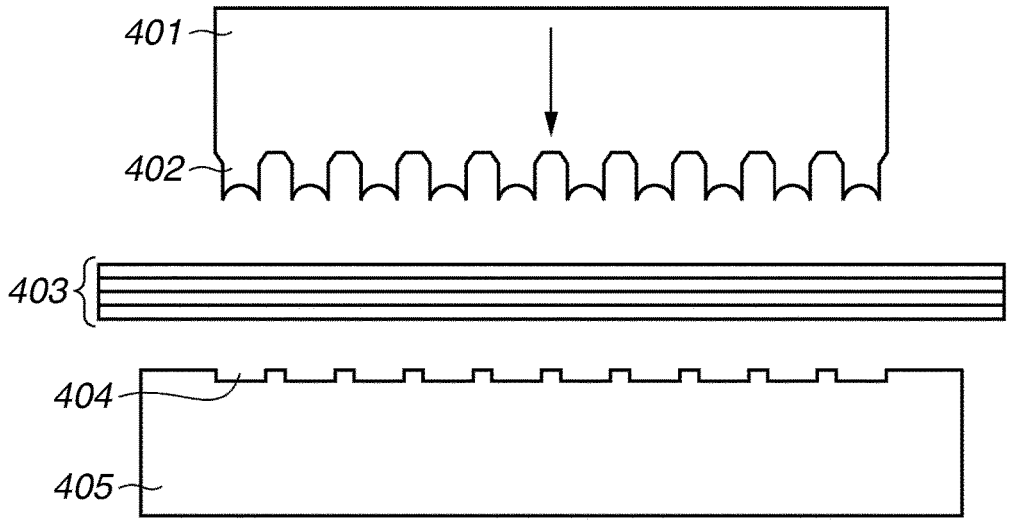
FIGS. 4A and 4B are cross sectional views illustrating binding processing of a second binding unit.
Figure 4B:
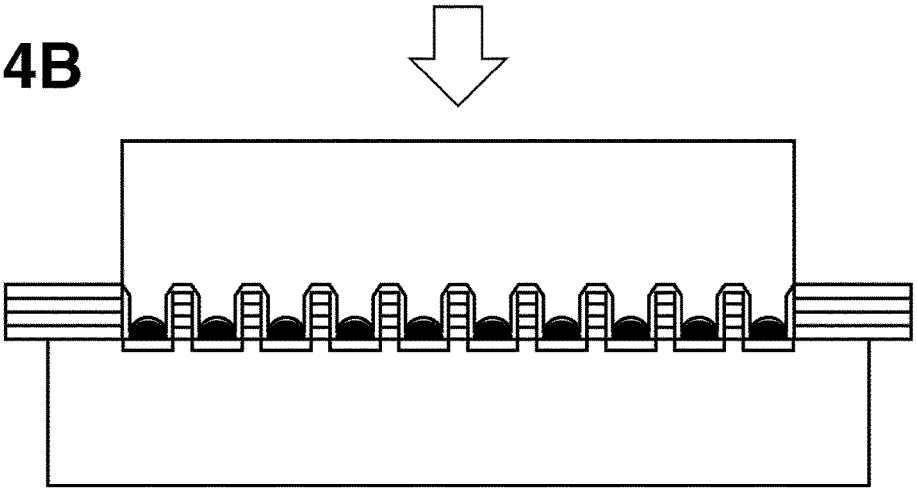
Figure 5:
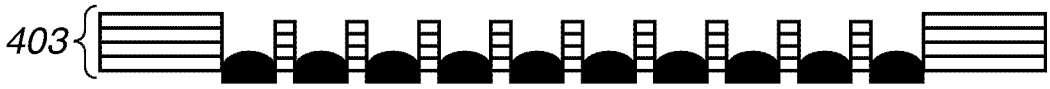
FIG. 5 is a cross sectional view illustrating binding processing by the second binding unit.

FIGS. 4A and 4B are cross sectional views illustrating binding processing by the second binding unit 203 illustrated in FIG. 2. A stapleless binding method for binding sheets by applying pressure thereto from the upside and downside (in the thickness direction) to achieve close contact therebetween will be described below. Specifically, FIG. 4A illustrates a state where sheets are set at the binding position, and the second binding unit 203 has moved to the binding position 303, as illustrated in FIG. 3.

Referring to FIGS. 4A and 4B, an upper mold 401 bears down the sheets with pressure. The upper mold 401 is provided with a plurality of convex blades. Applying pressure onto the sheets at a plurality of portions enables preventing the sheets from easily being apart. A lower mold 405 bears down the sheets with pressure. The lower mold 405 is provided with a plurality of concave portions 404 corresponding to convex portions 402 of the upper mold 401 to mate the blades of the upper mold 401. As illustrated in FIG. 4B, the upper mold 401 and the lower mold 405 apply pressure onto an output sheet bundle 403 from the upside and downside, respectively (by using a not illustrated pressurization mechanism), thus enabling binding of the output sheet bundle 403. The cross section of the output sheet bundle 403 after binding processing is as illustrated in FIG.

5. When the sheet bundle 403 is viewed from above, a binding position 601 is as illustrated in FIG. 6.

Figure 6:
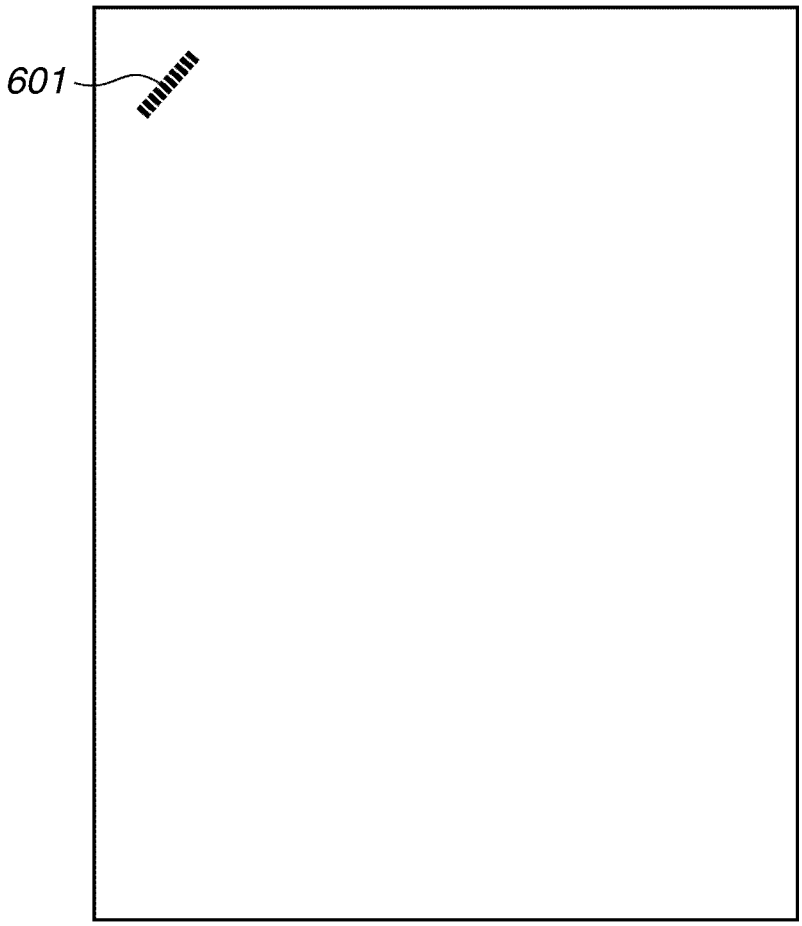
FIG. 6 illustrates a binding position.

In the present exemplary embodiment, black portions at the binding position 601 illustrated in FIG. 6 indicate sheet portions pressurized and crushed. Since this method uses pressure, the number of bindable sheets is limited at present. Further, binding processing can be applied twice because one binding processing might provide a weak binding force.

Test print processing by an image processing apparatus 100 according to the present exemplary embodiment using the above-described system unit will be described below with reference to the flowchart illustrated in FIG. 7. A program according to the flowchart is stored in a program ROM 102, loaded into the DRAM 104, and executed by the CPU 101.

Figure 7:
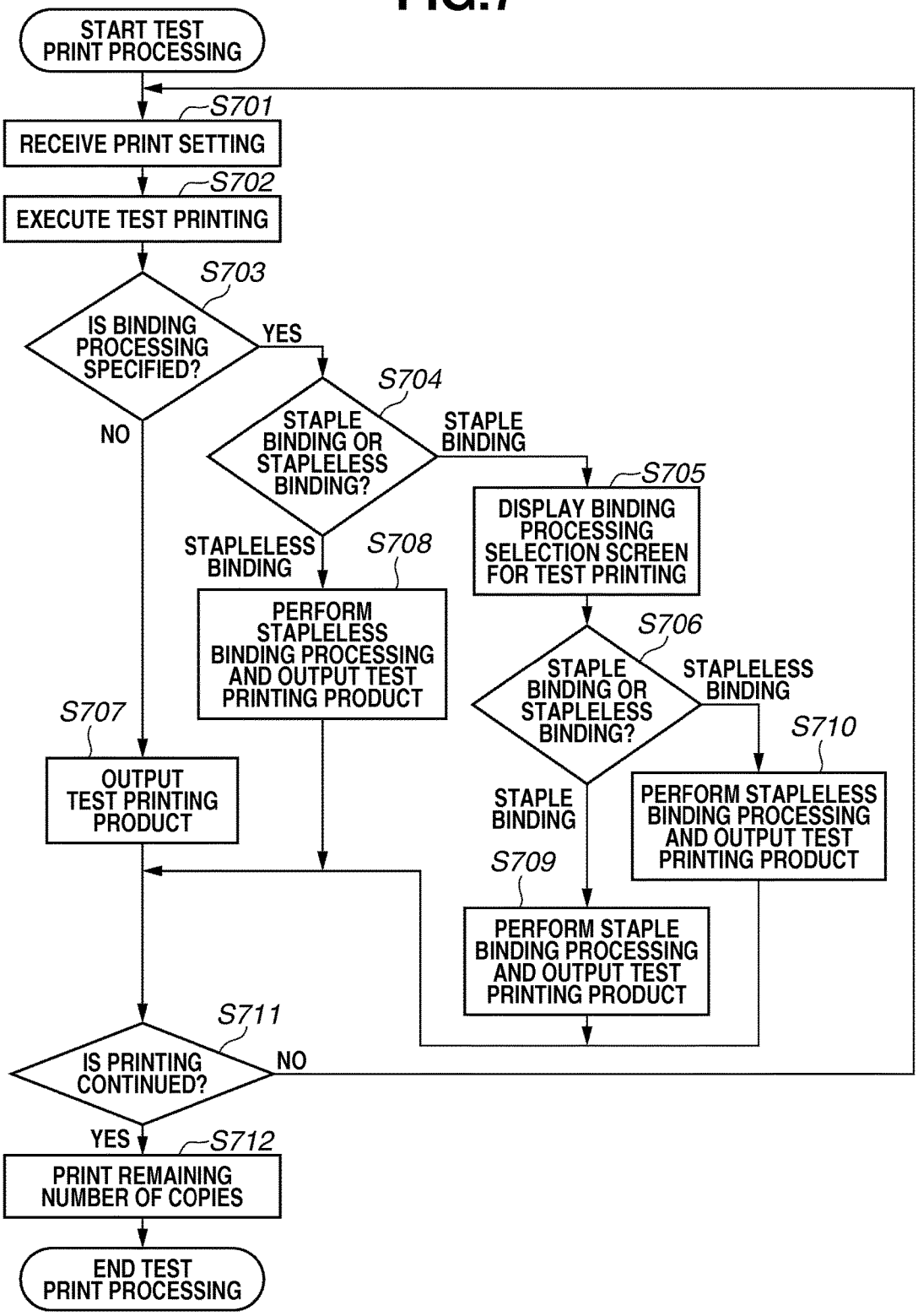
FIG. 7 is a flowchart illustrating a method for controlling the printing control apparatus.

FIG. 7 is a flowchart illustrating a method for controlling the printing control apparatus according to the present exemplary embodiment. In this example, when the user specifies test printing and further specifies staple binding processing with the image processing apparatus 100, the user is allowed to select whether staple binding processing or stapleless binding processing for binding processing of an output product of test printing. Each step is implemented by the CPU 101 illustrated in FIG. 1 executing a program for implementing the flowchart in FIG. 7 stored in the ROM 102.

In step S701, the CPU 101 receives a print setting including a test printing specification set by the user with the operation unit 105. If the user specifies binding processing, the print setting also includes a binding processing specification. In step S702, the CPU 101 controls the recording unit 107 and the image processing unit 108 to generate a print job including the print setting and then perform test printing based on image data.

In step S703, the CPU 101 analyzes the print job including the print setting to determine whether binding processing is specified. If the CPU 101 determines that the print job includes a binding processing specification (YES in step S703), then in step S704, the CPU 101 determines whether the specified binding processing is staple binding processing or stapleless binding processing.

Figure 11:
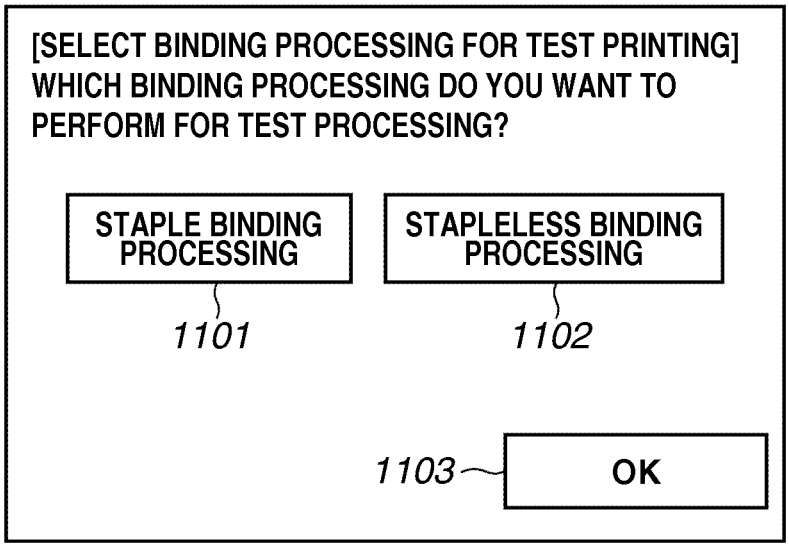
FIG. 11 illustrates a user interface (UI) screen displayable on an operation unit.

If the CPU 101 determines that staple binding processing is set (STAPLE BINDING in step S704), then in step S705, the CPU 101 displays on the display of the operation unit 105 a UI screen for selecting binding processing for test printing illustrated in FIG. 11.

Then, the CPU 101 receives the type of binding processing via buttons selected by using the UI screen illustrated in FIG. 11 displayed on the operation unit 105. In step S706, on the UI screen illustrated in FIG. 11, the CPU 101 determines which of a "STAPLE BINDING PROCESSING" button 1101 and a "STAPLELESS BINDING PROCESSING" button 1102 is selected by the user.

If the CPU 101 determines that the user selects the "STAPLELESS BINDING PROCESSING" button 1102 for test printing (STAPLELESS BINDING in step S706), then in step S710, the CPU 101 instructs the sheet processing unit 109 to perform stapleless binding processing. Then, the sheet processing unit 109 performs stapleless binding processing and then outputs a print product for test printing. After the print product for test printing is output, the user checks the print product.

In step S711, the user selects whether to continue or not to continue print processing by using a UI screen (not illustrated), and the CPU 101 determines which processing the user selects. If the CPU 101 determines that the user instructs not to continue print processing (NO in step S711), the processing returns to step S701.

On the other hand, if the CPU 101 determines that the user instructs to continue print processing (YES in step S711), then in step S712, the CPU 101 calculates the remaining number of copies and then controls the recording unit 107 to print the remaining number of copies based on image data. Then, the processing exits this flowchart. In step S712, the CPU 101 performs printing based on the print setting received in step S701. If the user specifies staple binding processing in step S701 and specifies stapleless binding processing in step S705, the CPU 101 does not count the print product for test printing as the number of copies.

On the other hand, if the CPU 101 determines that the user selects the "STAPLE BINDING PROCESSING" button 1101 (STAPLE BINDING in step S706), then in step S709, the CPU 101 instructs the sheet processing unit 109 to perform staple binding processing. Then, the sheet processing unit 109 performs staple binding processing and then outputs a print product for test printing. After the print product for test printing is output, the user checks the print product. In step S711, the user selects whether to continue or not to continue print processing by using a UI screen (not illustrated), and the CPU 101 determines which processing the user selects. If the CPU 101 determines that the user instructs not to continue print processing (NO in step S711), the processing returns to step S701.

On the other hand, if the CPU 101 determines that the user instructs to continue print processing (YES in step S711), then in step S712, the CPU 101 calculates the remaining number of copies and then controls the recording unit 107 to print the remaining number of copies based on image data. If the user specifies staple binding processing in step S701 and specifies staple binding processing also in step S705, the CPU 101 counts the print product for test printing as the number of copies.

On the other hand, if the CPU 101 determines that stapleless binding processing is set (STAPLELESS BINDING in step S704), then in step S708, the CPU 101 instructs the sheet processing unit 109 to perform stapleless binding processing. Then, the sheet processing unit 109 performs stapleless binding processing and then outputs a print product for test printing. After the print product for test printing is output, the user checks the print product. In step S711, the user selects whether to continue or not to continue print processing by using a UI screen (not illustrated), and the CPU 101 determines which processing the user selects. If the CPU 101 determines that the user instructs not to continue print processing (NO in step S711), the processing returns to step S701.

On the other hand, if the CPU 101 determines that the user instructs to continue print processing (YES in step S711), then in step S712, the CPU 101 calculates the remaining number of copies and then controls the recording unit 107 to print the remaining number of copies based on image data. If the user specifies stapleless binding processing in step S701, the CPU 101 counts the print product for test printing as the number of copies.

On the other hand, if the CPU 101 determines that binding processing is not specified (NO in step S703), then in step S707, the CPU 101 instructs the sheet processing unit 109 to output the print product as it is. Then, the sheet processing unit 109 outputs the print product for test printing without performing binding processing. Then, the user checks the print product for test printing. In step S711, the user selects whether to continue or not to continue print processing by using a UI screen (not illustrated), and the CPU 101 determines which processing the user selects. If the CPU 101 determines that the user instructs not to continue print processing (NO in step S711), the processing returns to step S701.

On the other hand, if the CPU 101 determines that the user instructs to continue print processing (YES in step S711), then in step S712, the CPU 101 calculates the remaining number of copies and then controls the recording unit 107 to print the remaining number of copies based on image data.

Thus, even if the image processing apparatus is set to perform staple binding processing, if the user wants to perform stapleless binding processing for test printing, the user selects stapleless binding processing to perform test printing without using a staple. In the example illustrated in FIG. 7, test printing is performed in step S702. However, the flowchart illustrated in FIG. 7 may be changed so that test printing is performed and a print product for test printing is output in each of step S707 to S710.

Figure 8:
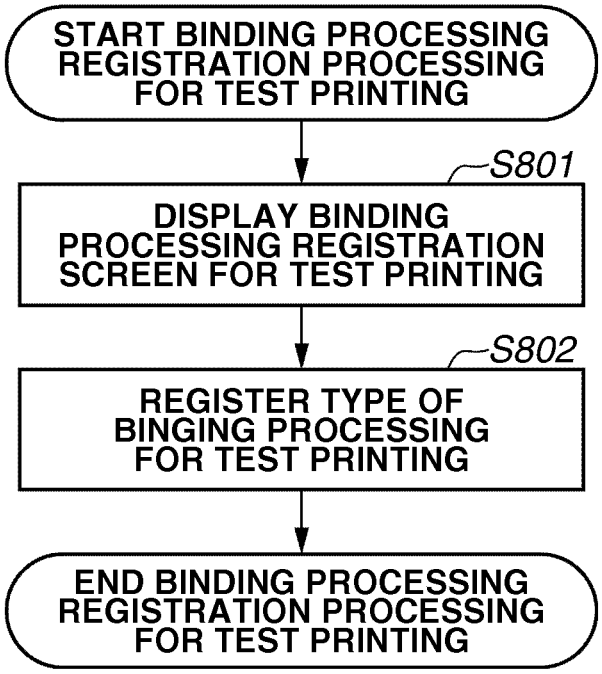
FIG. 8 is a flowchart illustrating a method for controlling the printing control apparatus.

A second exemplary embodiment will be described below. FIG. 8 is a flowchart illustrating a method for controlling a printing control apparatus according to the present exemplary embodiment. In this example, the user registers in advance binding processing for test printing to the image processing apparatus. Each step is implemented by the CPU 101 illustrated in FIG. 1 executing a program for implementing the flowchart in FIG. 8 stored in the ROM 102.

The CPU 101 receives an instruction entered on the operation unit 105 by the user. In step S801, if the CPU 101 determines that the received instruction is an instruction for displaying a UI screen illustrated in FIG. 12 for registering binding processing for test printing, the CPU 101 displays the UI screen illustrated in FIG. 12 on the display of the operation unit 105.

Figure 12:
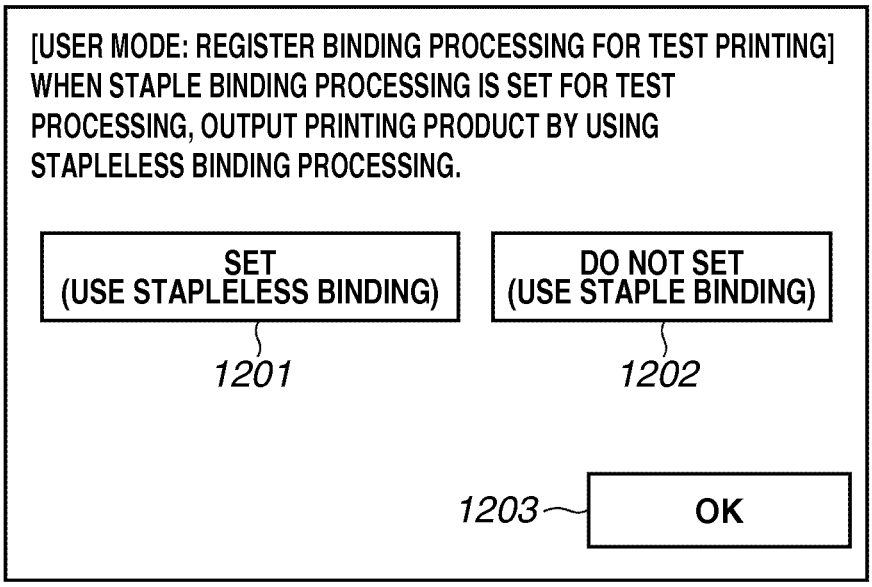
FIG. 12 illustrates a UI screen displayable on the operation unit.

Then, the user presses a "SET (USE STAPLELESS BINDING)" button 1201 or a "DO NOT SET (USE STAPLE BINDING)" button 1202 on the UI screen illustrated in FIG. 12 displayed on the display of the operation unit 105. In step S802, the CPU 101 registers the binding processing for test printing corresponding to the button pressed by the user, and the processing exits the flowchart. The "SET (USE STAPLELESS BINDING)" button 1201 functions as a button for instructing stapleless binding processing. The "DO NOT SET (USE STAPLE BINDING)" button 1202 functions as a button for instructing staple binding processing. An OK button 1203 instructs to register the contents of the "SET (USE STAPLELESS BINDING)" button 1201 or the "DO NOT SET (USE STAPLE BINDING)" button 1202.

Figure 9:
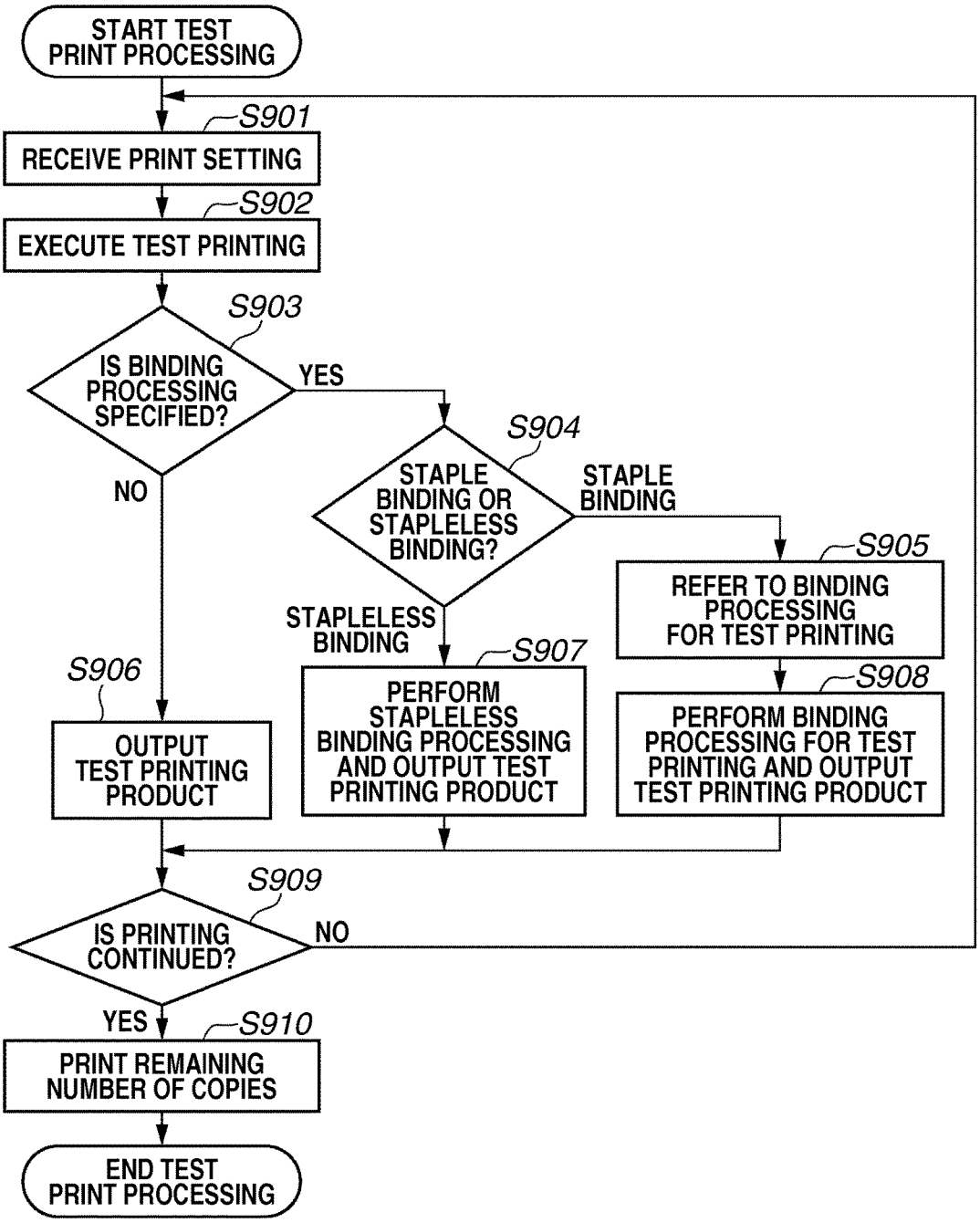
FIG. 9 is a flowchart illustrating a method for controlling the printing control apparatus.

FIG. 9 is a flowchart illustrating a method for controlling the printing control apparatus according to the present exemplary embodiment. In this example, the user registers in advance binding processing for test printing to the image processing apparatus 100, and the image processing apparatus 100 performs the registered binding processing for test printing. Each step is implemented when the CPU 101 illustrated in FIG. 1 executes a program for implementing the flowchart in FIG. 9 stored in the ROM 102.

In step S901, the CPU 101 receives a print setting including a test printing specification set by the user with the operation unit 105. If the user specifies binding processing, the print setting also includes a binding processing specification. In step S902, the CPU 101 controls the recording unit 107 and the image processing unit 108 to generate a print job including the print setting and then perform test printing based on image data.

In step S903, the CPU 101 analyzes the print job including the print setting to determine whether binding processing is specified. If the CPU 101 determines that the print job includes a binding processing specification (YES in step S903), then in step S904, the CPU 101 determines whether the specified binding processing is staple binding processing or stapleless binding processing.

If the CPU 101 determines that staple binding processing is set (STAPLE BINDING in step S904), then in step S905, the CPU refers to the binding processing registered in advance by the user.

In step S908, the CPU 101 instructs the sheet processing unit 109 to perform the registered binding processing. Then, the sheet processing unit 109 performs the registered binding processing and then outputs a print product for test printing. Then, the processing proceeds to step S909.

In step S909, the user selects whether to continue or not to continue print processing by using a UI screen (not illustrated), and the CPU 101 determines which processing the user selects. If the CPU 101 determines that the user instructs not to continue print processing (NO in step S909), the processing returns to step S901.

On the other hand, if the CPU 101 determines that the user instructs to continue print processing (YES in step S909), then in step S910, the CPU 101 calculates the remaining number of copies and then controls the recording unit 107 to print the remaining number of copies based on image data. Then, the processing exits this flowchart. In step S910, printing is performed based on the print setting received in step S901. If the user specifies staple binding processing in step S901 and registers stapleless binding processing in step S802, the CPU 101 does not count the print product for test printing as the number of copies.

On the other hand, when the CPU 101 determines that stapleless binding processing is set (STAPLELESS BINDING in step S904), then in step S907, the CPU 101 instructs the sheet processing unit 109 to perform stapleless binding processing. Then, the sheet processing unit 109 performs stapleless binding processing and then outputs a print product for test printing. After the print product for test printing is output, the user checks the print product. In step S909, the user selects whether to continue or not to continue print processing by using a UI screen (not illustrated), and the CPU 101 determines which processing the user selects. If the CPU 101 determines that the user instructs not to continue print processing (NO in step S909), the processing returns to step S901.

On the other hand, if the CPU 101 determines that the user instructs to continue print processing (YES in step S909), then in step S910, the CPU 101 calculates the remaining number of copies and then controls the recording unit 107 to print the remaining number of copies based on image data. If the user specifies stapleless binding processing in step S901, the CPU 101 counts the print product for test printing as the number of copies.

On the other hand, If the CPU 101 determines that binding processing is not specified (NO in step S903), then in step S906, the CPU 101 instructs the sheet processing unit 109 to output the print product as it is. Then, the sheet processing unit 109 outputs the print product for test printing without performing binding processing. Then, the user checks the print product. In step S909, the user selects whether to continue or not to continue print processing by using a UI screen (not illustrated), and the CPU 101 determines which processing the user selects. If the CPU 101 determines that the user instructs not to continue print processing (NO in step S909), the processing returns to step S901.

On the other hand, if the CPU 101 determines that the user instructs to continue print processing (YES in step S909), then in step S910, the CPU 101 calculates the remaining number of copies and then controls the recording unit 107 to print the remaining number of copies based on image data.

According to the above processing, if binding processing is registered as a print setting, the CPU 101 performs the registered binding processing referring to the binding processing registered by the user, without inquiring the user about the type of binding processing for test printing. If stapleless binding processing is registered, the CPU 101 automatically selects stapleless binding processing to enable performing test printing without using a staple.

A third exemplary embodiment will be described below. The present exemplary embodiment will be described below based on a case where, when the user specifies test printing, the image processing apparatus 100 determines the binding processing for test printing according to whether the binding function is enabled.

Figure 10:
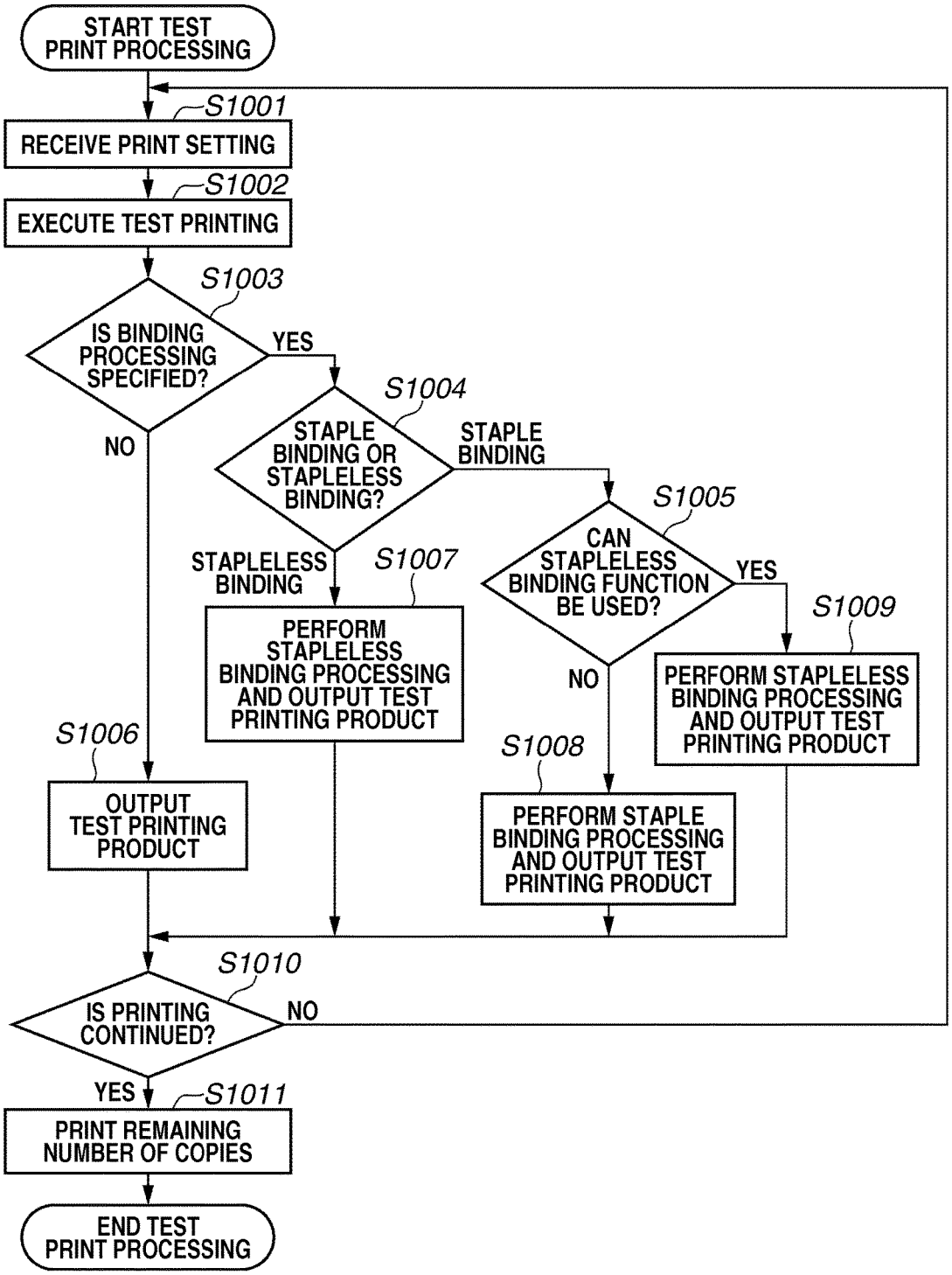
FIG. 10 is a flowchart illustrating a method for controlling the printing control apparatus.

FIG. 10 is a flowchart illustrating a method for controlling the printing control apparatus according to the present exemplary embodiment. In this example, when the user specifies test printing and staple binding processing with the image processing apparatus 100, the image processing apparatus 100 obtains whether the binding function is enabled and, if it is enabled, forcibly changes the type of binding processing for test printing to stapleless binding processing. Each step is implemented by the CPU 101 illustrated in FIG. 1 executing a program for implementing the flowchart in FIG. 10 stored in the ROM 102.

In step S1001, the CPU 101 receives a print setting including a test printing specification set by the user with the operation unit 105. If the user specifies binding processing, the print setting also includes a binding processing specification. In step S1002, the CPU 101 controls the recording unit 107 and the image processing unit 108 to generate a print job including the print setting and then perform test printing based on image data.

In step S1003, the CPU 101 analyzes the print job including the print setting to determine whether binding processing is specified. If the CPU 101 determines that the print job includes a binding processing specification (YES in step S1003), then in step S1004, the CPU 101 determines whether the specified binding processing is staple binding processing or stapleless binding processing.

If the CPU 101 determines that staple binding processing is set (STAPLE BINDING in step S1004), then in step S1005, the CPU determines whether the stapleless binding function of the image processing apparatus 100 is enabled. If the CPU 101 determines that the stapleless binding function is enabled (YES in step S1005), then in step S1009, the CPU 101 instructs the sheet processing unit 109 to perform stapleless binding processing. Then, the sheet processing unit 109 performs stapleless binding processing and then outputs a print product for test printing. Then, the processing proceeds to step S1010.

On the other hand, if the CPU 101 determines that the stapleless binding function is not enabled (NO in step S1005), then in step S1008, the CPU 101 instructs the sheet processing unit 109 to perform staple binding processing. Then, the sheet processing unit 109 performs staple binding processing and then outputs a print product for test printing. Then, the processing proceeds to step S1010.

In step S1010, the user selects whether to continue or not to continue print processing by using a UI screen (not illustrated), and the CPU 101 determines which processing the user selects. If the CPU 101 determines that the user instructs not to continue print processing (NO in step S1010), the processing returns to step S1001.

On the other hand, if the CPU 101 determines that the user instructs to continue print processing (YES in step S1010), then in step S1011, the CPU 101 calculates the remaining number of copies and then controls the recording unit 107 to print the remaining number of copies based on image data. Then, the processing exits this flowchart.

If the user specifies staple binding processing in step S1001 and the stapleless binding function is enabled, the CPU 101 does not count the print product for test printing as the number of copies. If the user specifies staple binding processing in step S1001 and the stapleless binding function is not enabled, the CPU 101 counts the print product for test printing as the number of copies.

On the other hand, if the CPU 101 determines that stapleless binding processing is set (STAPLELESS BINDING in step S1004), then in step S1007, the CPU 101 instructs the sheet processing unit 109 to perform stapleless binding processing. Then, the sheet processing unit 109 performs stapleless binding processing and then outputs a print product for test printing. After the print product for test printing is output, the user checks the print product. In step S1010, the user selects whether to continue or not to continue print processing by using a UI screen (not illustrated), and the CPU 101 determines which processing the user selects. If the CPU 101 determines that the user instructs not to continue print processing (NO in step S1010), the processing returns to step S1001.

On the other hand, if the CPU 101 determines that the user instructs to continue print processing (YES in step S1010), then in step S1011, the CPU 101 calculates the remaining number of copies and then controls the recording unit 107 to print the remaining number of copies based on image data.

If the user specifies stapleless binding processing in step S1001, the CPU counts the print product for test printing as the number of copies.

On the other hand, if the CPU 101 determines that binding processing is not specified (NO in step S1003), then in step S1006, the CPU 101 instructs the sheet processing unit 109 to output the print product as it is. Then, the sheet processing unit 109 outputs the print product for test printing without performing binding processing. After the print product for test printing is output, the user checks the print product. In step S1010, the user selects whether to continue or not to continue print processing by using a UI screen (not illustrated), and the CPU 101 determines which processing the user selects. If the CPU 101 determines that the user instructs not to continue print processing (NO in step S1010), the processing returns to step S1001.

On the other hand, if the CPU 101 determines that the user instructs to continue print processing (YES in step S1010), then in step S1011, the CPU 101 calculates the remaining number of copies and then controls the recording unit 107 to print the remaining number of copies based on image data.

According to the above processing, even if the image processing apparatus 100 is set to perform staple binding processing, if stapleless binding processing is enabled, automatically changing the type of binding processing to stapleless binding processing enables achieving binding processing without using a staple.

Although, in the present exemplary embodiment, a print job is generated from image data read by the reading unit 106, the present invention is also applicable to an image processing apparatus that communicates with a data processing apparatus by using a communication interface 111 via a network 112 illustrated in FIG. 1. In that case, the image processing apparatus receives a print job having a test printing mode setting through communication with the data processing apparatus via the network 112. If necessary, it is also possible to provide a user of the data processing apparatus with a UI screen for selecting stapleless binding processing in the test printing mode, and to reflect the user's selection made on the data processing apparatus to the processing of the print job.

On the print job setting screen provided by the data processing apparatus, it may be configured that binding processing in the test printing mode specified by the user is accepted and registered as a binding processing function.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., a non-transitory computer-readable storage medium). In such a case, the system or apparatus, and the recording medium where the program is stored, are included as being within the scope of the present invention.

According to the present exemplary embodiment, performing stapleless binding processing, instead of applying staple binding processing, for test printing enables reducing the amount of staples used and eliminating the need of removing a staple from a print product for test printing.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-035977 filed Feb. 22, 2012, which is hereby incorporated by reference herein in its entirety.

What is claimed is:

1. A printing control apparatus configured to control a first binding unit to perform a binding processing of binding a plurality of sheets with a staple, and a second binding unit to perform a binding processing of binding a plurality of sheets without a staple, the printing control apparatus comprising:

a printing unit that prints, based on a print job, image data on a sheet; and a control unit that, except in a case where binding processing for test printing by the first binding unit is indicated, controls the second binding unit to perform the binding processing without a staple for test printing even if the binding processing for binding a plurality of printed sheets with a staple is designated for the print job, and that controls the first binding unit to perform the binding processing with a staple for remaining printing of the print job after test printing, wherein at least the control unit is implemented by a processor and a memory.

2. The printing control apparatus according to claim 1, further comprising a selection unit configured, in a case where test printing is specified, to select, based on user instruction, whether to execute binding processing by the second binding unit for test printing or to execute binding processing by the first binding unit for test printing, wherein, in a case where binding processing for test printing by the second binding unit is selected, the control unit controls the second binding unit to perform the binding processing for binding sheets printed for test printing, and wherein, in a case where binding processing for test printing by the first binding unit is selected, the control unit controls the first binding unit to perform the binding processing for binding sheets printed for test printing.

3. The printing control apparatus according to claim 2, further comprising a setting unit configured to set a number of copies, wherein, in a case where binding processing by the second binding unit is selected, the control unit controls the printing unit to print, after test printing, image data on a sheet for the number of copies set by the setting unit, and wherein, in a case where binding processing by the first binding unit is selected, the control unit controls the printing unit to print, after test printing, image data on a sheet for the number of copies set by the setting unit minus one.

4. The printing control apparatus according to claim 2, wherein, in a case where test printing is specified and binding processing by the first binding unit is specified, the selection unit selects, based on user instruction, whether to execute binding processing for test printing by the second binding unit or to execute binding processing for test printing by the first binding unit.

5. The printing control apparatus according to claim 1, further comprising a registration unit configured to register, in advance, whether to execute binding processing for test printing by the second binding unit or to execute binding processing for test printing by the first binding unit, wherein, in a case where binding processing for test printing by the second binding unit is registered, the control unit controls the second binding unit to perform the binding processing for test printing, and wherein, in a case where binding processing for test printing by the first binding unit is registered, the control unit controls the first binding unit to perform the binding processing for test printing.

6. The printing control apparatus according to claim 1, further comprising a determination unit configured, in a case where test printing is specified, to determine whether binding processing by the second binding unit is possible, wherein, in a case where binding processing by the second binding unit is determined to be possible, the control unit controls the second binding unit to perform the binding processing for test printing, and wherein, in a case where binding processing by the second binding unit is determined not to be possible, the control unit controls the first binding unit to perform the binding processing for test printing.

7. The printing control apparatus according to claim 1, wherein, in a case where test printing is specified and performing the binding processing for binding a plurality of printed sheets without a staple is designated for the print job, the control unit controls the second binding unit to perform the binding processing for test printing, and controls the second binding unit to perform the binding processing for remaining printing after test printing.

8. The printing control apparatus according to claim 1, wherein, in binding processing by the second binding unit, a plurality of sheets are pressurized to achieve close contact between the plurality of sheets.

* * * * *